US009901768B1

(12) United States Patent
Wu

(10) Patent No.: US 9,901,768 B1
(45) Date of Patent: Feb. 27, 2018

(54) ROWING EXERCISE MACHINE

(71) Applicant: Strength Master Fitness Tech. Co., Ltd., Puxin Township (TW)

(72) Inventor: Shu-Yao Wu, Puxin Township (TW)

(73) Assignee: Strength Master Fitness Tech. Co., Ltd., Puxin Township (TW)

( * ) Notice: Subject to any disclaimer, the term of this patent is extended or adjusted under 35 U.S.C. 154(b) by 0 days.

(21) Appl. No.: 15/423,895

(22) Filed: Feb. 3, 2017

(51) Int. Cl.

| | |
|---|---|
| ***A63B 24/00*** | (2006.01) |
| ***A63B 21/005*** | (2006.01) |
| ***A63B 21/00*** | (2006.01) |
| ***A63B 22/00*** | (2006.01) |
| ***A63B 71/06*** | (2006.01) |

(52) U.S. Cl.
CPC ..... *A63B 21/0058* (2013.01); *A63B 21/154* (2013.01); *A63B 21/4034* (2015.10); *A63B 21/4035* (2015.10); *A63B 22/0076* (2013.01); *A63B 24/0087* (2013.01); *A63B 71/0619* (2013.01); *A63B 2022/0079* (2013.01); *A63B 2071/0658* (2013.01)

(58) Field of Classification Search
CPC ..... A63B 21/0058; A63B 21/4034; A63B 21/154; A63B 21/4035; A63B 22/0076; A63B 24/0087; A63B 71/0619; A63B 2022/0079; A63B 2071/0658
See application file for complete search history.

(56) References Cited

U.S. PATENT DOCUMENTS

| | | | | |
|---|---|---|---|---|
| 4,735,410 A * | 4/1988 | Nobuta | A61B 5/222 482/73 |
| 5,919,115 A * | 7/1999 | Horowitz | A63B 21/00181 482/1 |
| 9,205,300 B2 * | 12/2015 | Ishii | A63B 21/0056 |
| 9,586,091 B2 * | 3/2017 | Reich | A63B 24/0062 |

* cited by examiner

*Primary Examiner* — Glenn Richman
(74) *Attorney, Agent, or Firm* — Wang Law Firm, Inc.

(57) ABSTRACT

The present disclosure illustrates a rowing exercise machine which includes a support structure, a power output module, a cable rolling device, a cable, a handle assembly and an operating module. The power output module is disposed at an end of the support structure. The power output module includes a motor, a controlling device and an encoder. The controlling device is connected to the motor, and receives a sensing signal and a setting signal, and transmits a control signal. The encoder is electrically connected to the controlling device and configured to sense an operational state of the motor and output the sensing signal. The cable rolling device is coupled to a torque enhancing device. An end of the cable is wound on the cable rolling device. The handle assembly is coupled on the other end of the cable. The operating module is connected to the power output module.

10 Claims, 6 Drawing Sheets

ROWING EXERCISE MACHINE

BACKGROUND OF THE INVENTION

1. Field of the Invention

The present disclosure relates to a rowing exercise machine. More particularly, the present disclosure relates to a rowing exercise machine using motor to provide resistance.

2. Description of the Related Art

Conventional rowing exercise machines usually use a fan based, a water box based or a magnetic force based device to provide resistance for pulling action during rowing exercise, but the resistance is usually only relative to a speed of the user's pulling action. Therefore, the conventional rowing exercise machine is hard to provide various resistances to meet the user's training demand. In order to assist the user to periodically complete the rowing action consisted of a pulling action and a recovery action, the conventional rowing exercise usually includes a recovery mechanism to provide a restoring force to receive a cable after the user completes the pulling action. As a result, the conventional rowing exercise machine has a more complicated structure. Furthermore, the restoring force of the recovery mechanism of the conventional rowing exercise machine is fixed, so the user is hard to simulate the action of recovering oar on the conventional rowing exercise machine. Therefore, what is need is to develop a rowing exercise machine which is capable of simulating various resistances for different training scenarios, to meet the user's demand.

SUMMARY OF THE INVENTION

In order to solve aforementioned problems, an objective of the present disclosure is to provide a rowing exercise machine which includes a support structure, a power output module, a cable rolling device, a cable, a handle assembly and an operating module. The power output module is disposed at an end of the support structure, and includes a motor, a controlling module, an encoder, The controlling device is electrically connected to the motor, and configured to receive a sensing signal and setting data, and generate a control signal according to the sensing signal and the setting data. The encoder is electrically connected to the controlling device and configured to sense an operational state of the motor and output the sensing signal. The cable rolling device is coupled to the power output module and rotated in same direction as the motor. The cable includes an end wound on the cable rolling device. The handle assembly is coupled to the other end of the cable and configured to be held by a user to complete a stroke of rowing action. The operating module is electrically connected to the power output module and configured to input the setting data to the controlling device. The stroke of rowing action includes a pulling action and a recovery action. During the pulling action, the power output module provides a reverse resistance against the pulling action, so that the motor counter-rotates correspondingly to the pulling action. When a force of the pulling action is lower than the reverse resistance, the motor is back to its original rotational direction. When sensing a change in the rotational direction of the motor, the encoder transmits the sensing signal to the controlling device, and the controlling device transmits the control signal to control the motor, so that the power output module provides a restoring force to drive the cable rolling device to receive the cable, thereby completing the recovery action.

Preferably, the power output module further includes a torque enhancing device coupled to the motor and configured to output a revolving speed lower than a revolving speed of the motor and a torque higher than a torque of the motor.

Preferably, the pulling action and the recovery action are horizontal motions, and a direction of the resistance outputted from the power output module is the same during the pulling action and the recovery action.

Preferably, the rowing exercise machine of the present disclosure further includes a movable user support and a foot plate which are disposed on the support structure.

Preferably, the power output module outputs different magnitudes of resistances during the pulling action and the recovery action.

Preferably, the rowing exercise machine of the present disclosure further includes a pulley disposed on the support structure, and the cable runs through the pulley.

Preferably, the rowing exercise machine of the present disclosure further includes a display device configured to display the setting data inputted into the power output module through the operating module.

Preferably, the operational state comprises a rotational position, a rotational velocity or a rotational acceleration of an output shaft of the motor.

Preferably, the resistance outputted from the power output module is fixed, or linearly or quadratically varied, or varied based on a preset function.

Preferably, a relationship between a change in resistance outputted from the power output module and the rotational position, velocity or the acceleration of the cable rolling device is a ratio relationship, a linear relationship, a quadratic relationship or a functional relationship.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
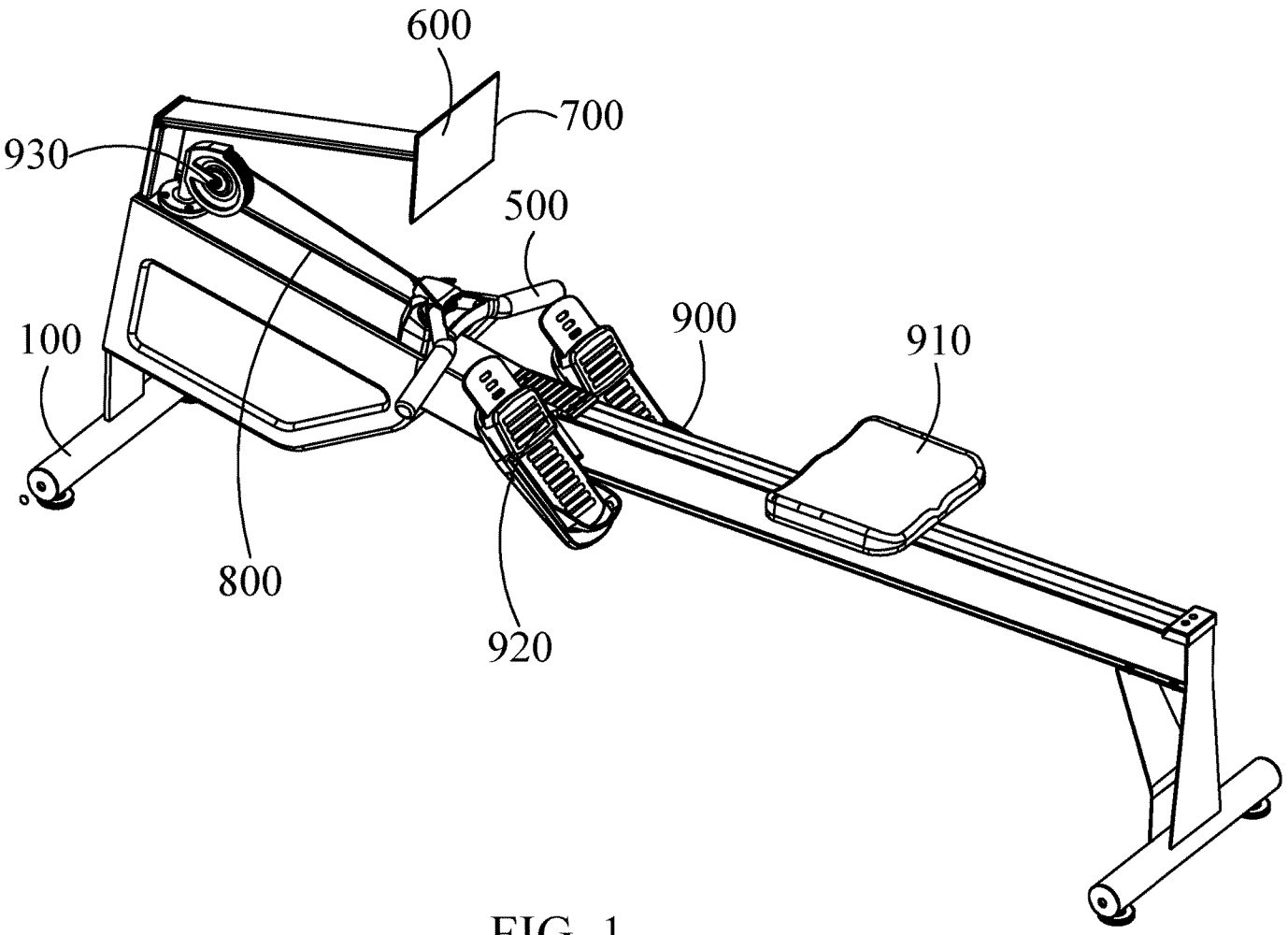
FIG. 1 is a schematic view of an embodiment of a rowing exercise machine of the present disclosure.

The following embodiments of the present invention are herein described in detail with reference to the accompanying drawings. These drawings show specific examples of the embodiments of the present invention. It is to be understood that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present invention. As used herein, the term "or" includes any and all combinations of one or more of the associated listed items.

Figure 2:
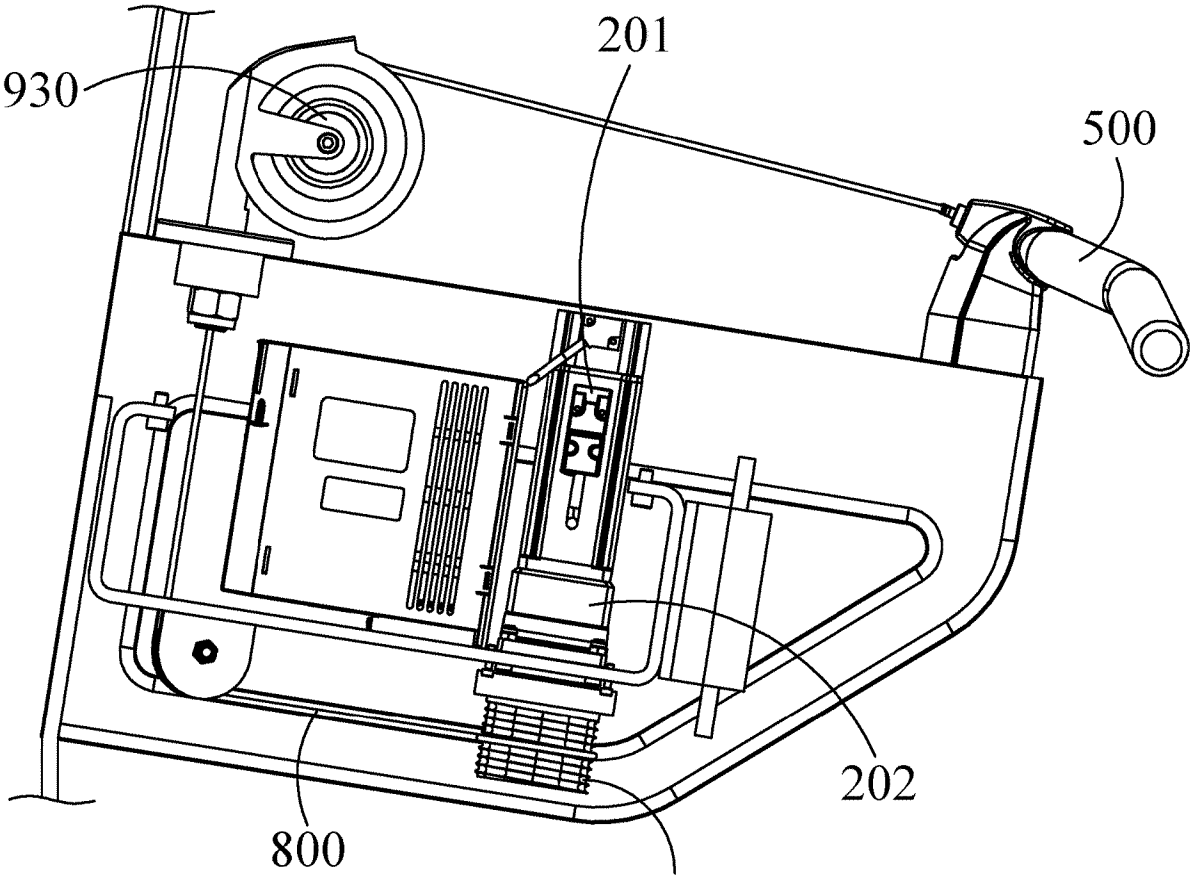
FIG. 2 is a schematic view of a part of the embodiment of the rowing exercise machine of the present disclosure.
Figure 3:
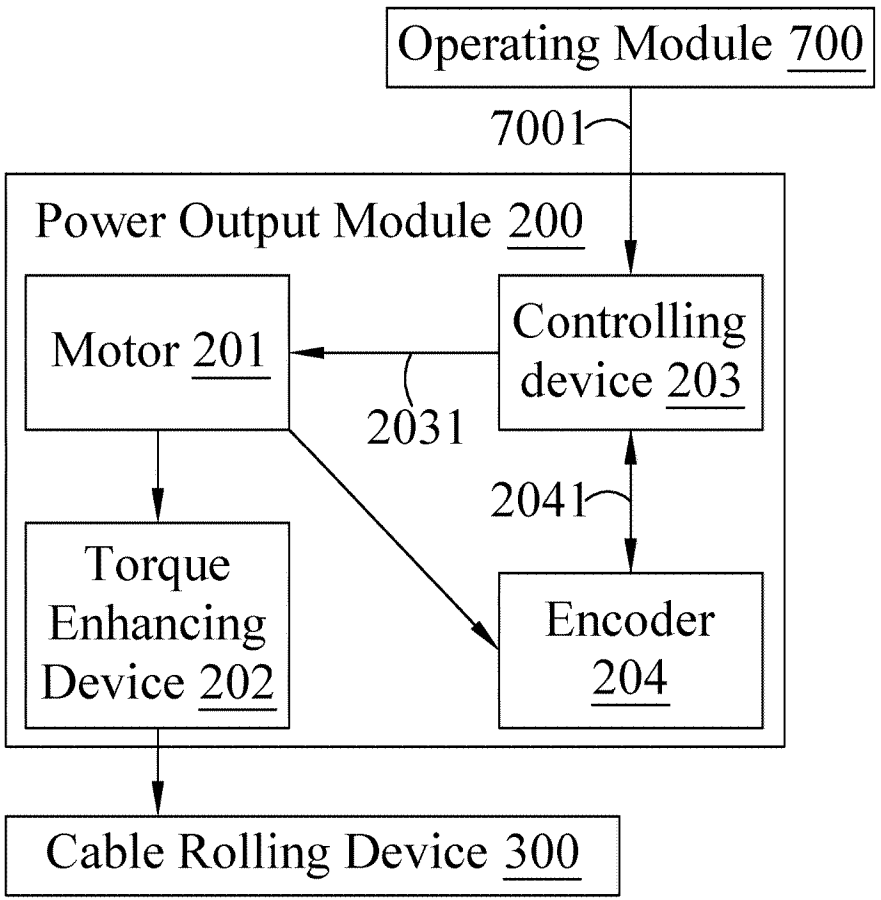
FIG. 3 is a system block diagram of the embodiment of the rowing exercise machine of the present disclosure.

The following refers to FIG. 1 through FIG. 3, which respectively show a schematic view of entire structure, a schematic view of a part, and a system block diagram of an embodiment of a rowing exercise machine of the present disclosure.

The rowing exercise machine includes a support structure 100, a power output module 200, a cable rolling device 300, a cable 800, a handle assembly 500 and an operating module 700.

The power output module 200 may be disposed at an end of the support structure 100. The power output module 200 may include a motor 201, a torque enhancing device 202, a controlling device 203 and an encoder 204. The torque enhancing device 202 is coupled to the motor 201. Under a condition that the motor 201 is unable to provide sufficient torque, the torque enhancing device 202 may output a revolving speed lower than that of the motor 201 and a torque higher than that of the motor 201. Furthermore, the torque enhancing device 202 may include a reducer. Preferably, the reducer may be a planetary gear reducer, a cycloidal gear reducer, and so on. By using the motor 201 in cooperation with the torque enhancing device 202 to increase the output torque, the power output module 200 is able to output sufficient resistance for the rowing exercise.

The controlling device 203 is electrically connected to the motor 201, and configured to receive a sensing signal 2041 and setting data 7001, and transmit a control signal 2031 according to the sensing signal 2041 and the setting data 7001. The encoder 204 is electrically connected to the controlling device 203, and configured to sense an operational state of the motor 201, and the encoder 204 then outputs the sensing signal 2041. Preferably, the operational state of the motor 201 may include a rotational position, a rotational velocity, an acceleration or current data. The encoder 204 transmits the sensing signal 2041 to the controlling device 203 to control the motor 201, thereby forming a feedback control scheme.

The encoder 204 is used for positioning control or speed control of precision machine. For this reason, in the embodiment, the encoder 204 is in cooperation with the motor 201. The encoder 204 may be classified into a rotary encoder and a linear encoder according to its mechanical structure; alternatively, the encoder 204 may be classified into an absolute encoder and a relative encoder according to its coding scheme. Furthermore, the encoder 204 may be classified into a mechanical encoder, an electromagnetic encoder, and optical encoder according to its signal generating scheme. For example, if the absolute encoder may be used to directly record the rotational position of the motor 201. Selecting which kind of the encoder 204 depends on practical demand and configurations of the motor 201 and the controlling device 203.

The resistance generated by the torque enhancing device 202 is transmitted to the handle assembly 500 through the cable 800 and the cable rolling device 300.

The cable rolling device 300 is coupled with the torque enhancing device 202, and an end of the cable 800 is wound on the cable rolling device 300, and the other end of the cable 800 is coupled with the handle assembly 500, so that the user can hold the handle assembly 500 to complete the stoke of rowing action.

The user can use the operating module 700 to input setting data 7001 for the power output module 200, so that the power output module 200 can generate different resistance according to the setting data 7001. The operating module 700 is electrically connected to the power output module 200, and the user inputs the setting data 7001 to the controlling device 203 through the operating module 700, thereby controlling the motor 201 and adjusting the resistance outputted by the power output module 200.

Furthermore, the rowing exercise machine of the present disclosure further includes a sliding rail structure 900, a movable user support 910, a foot plate 920 and a display device 600.

The sliding rail structure 900 may be disposed on the support structure 100, and the movable user support 910 is slidable on the sliding rail structure 900. The foot plate 920 may be disposed on the support structure 100, and disposed between the power output module 200 and the sliding rail structure 900. A pulley 930 is disposed on the support structure 100, and the cable 800 runs through the pulley 930.

The display device 600 is configured to display the setting data inputted for the power output module through the operating module 700. In other embodiment, the operating module 700 can be integrated with the display device 600 by a touch control manner, so that the user may directly touch the display device 600 to use the operating module 700 for inputting the setting data for the power output module 200.

Figure 4:
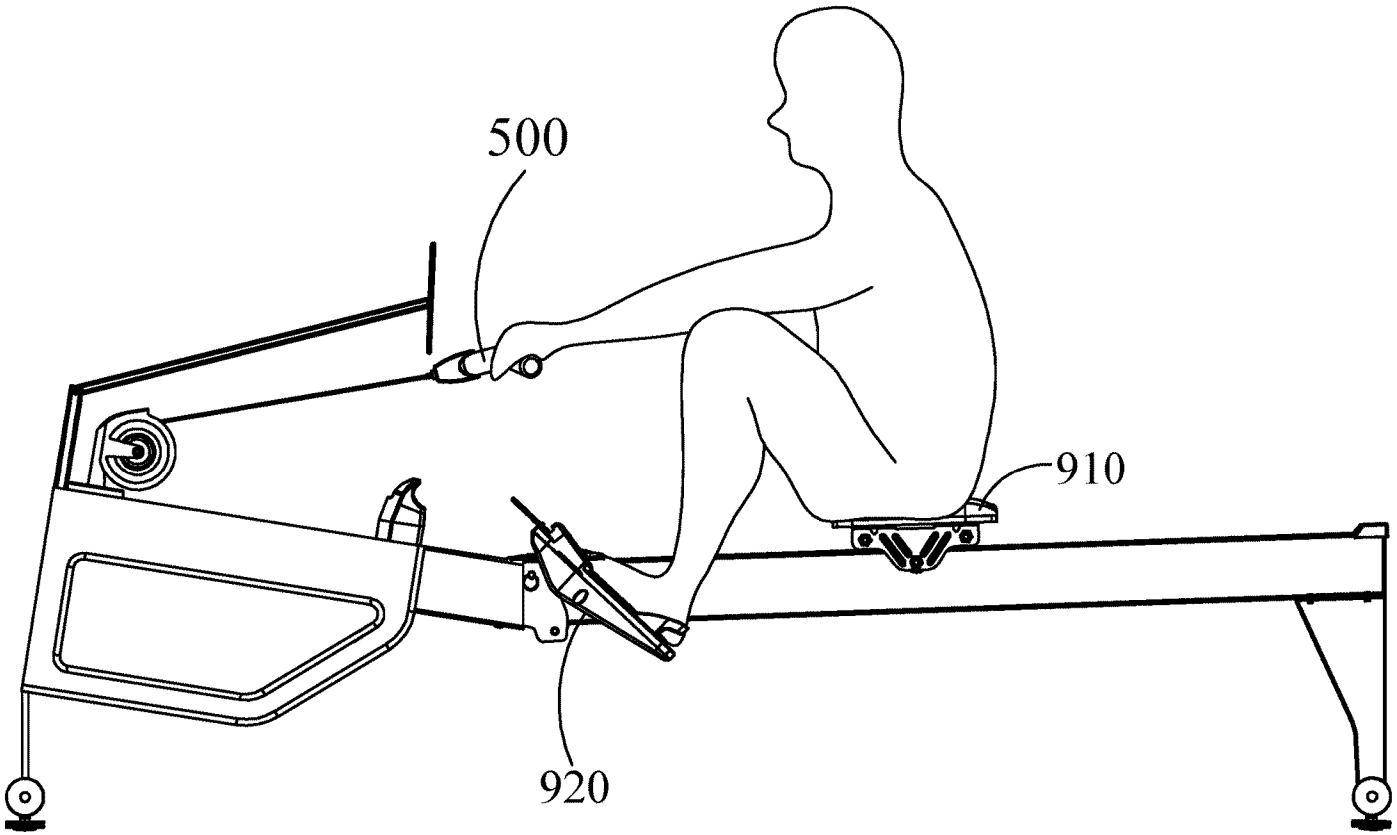
FIG. 4 is a schematic view showing a first operative status of the embodiment of the rowing exercise machine of the present disclosure.
Figure 5:
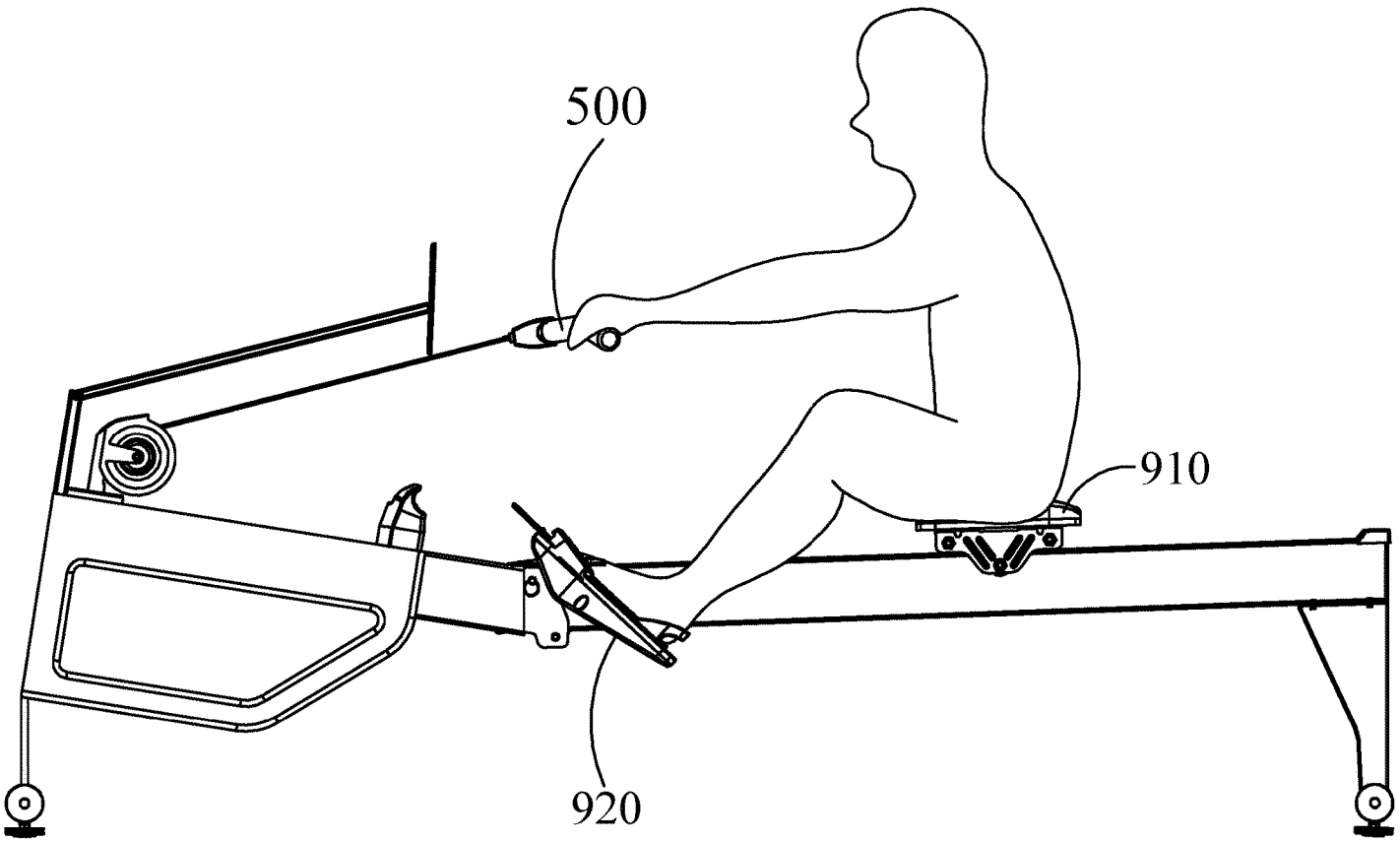
FIG. 5 is a schematic view showing a second operative status of the embodiment of the rowing exercise machine of the present disclosure.
Figure 6:
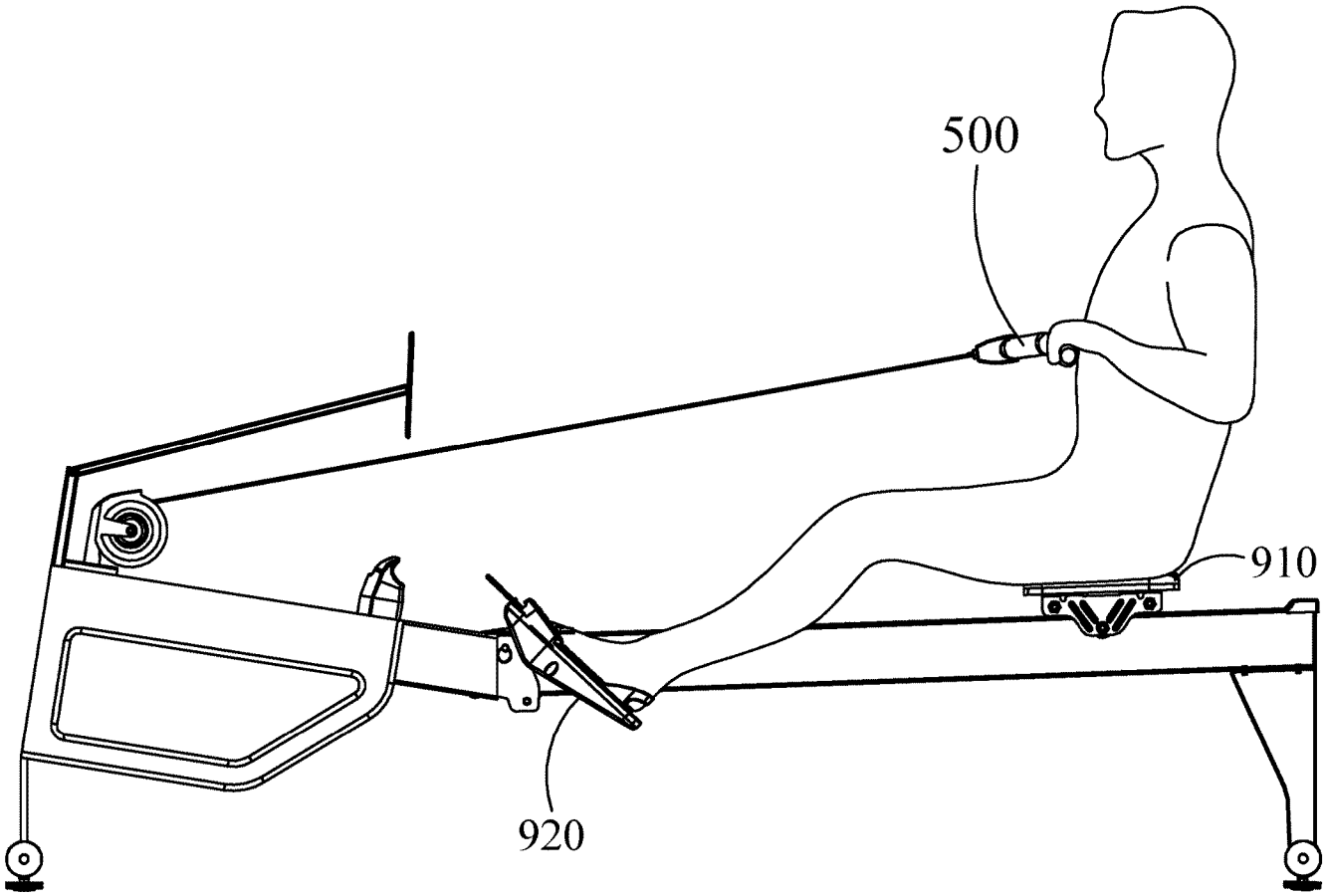
FIG. 6 is a schematic view showing a third operative status of the embodiment of the rowing exercise machine of the present disclosure.

The following refers to FIG. 3 through FIG. 6. FIGS. 4-6 respectively show schematic views of the first, second and third operative statuses of the embodiment of the rowing exercise machine of the present disclosure.

The stroke of rowing action includes a pulling action and a recovery action which both are horizontal motions. While the user holds the handle assembly 500 to do the pulling action, the power output module 200 provides a reverse resistance against the pulling action, and the motor 201 counter-rotates correspondingly to the pulling action. When the user's force applied on the handle assembly 500 is lower than the reverse resistance, the motor 201 is back to its original rotational direction, so that the reverse resistance outputted by the power output module 200 becomes a restoring force to drive the cable rolling device 300 to receive the cable 800. The encoder 204 may sense a change in the rotational direction of the motor 201 and transmits the sensing signal 2041 to the controlling device 203. The controlling device 203 transmits the control signal 2031 to control the motor 201. Alternatively, the user may adjust, such as increase or decrease, the restoring force of the recovery action through the operating module 700.

The stroke of rowing action may be classified into two modes. In the first mode, an initial posture of the stroke may be the posture shown in FIG. 4 or FIG. 5 upon the user's joint activity or exercise habit. After the initial action, the user uses leg muscles, core muscles, back muscles, and hand muscles to pull back the handle assembly 500, thereby completing the pulling action as shown in FIG. 6, and the user is then back to the initial posture (shown in FIG. 4 or FIG. 5) from the pulling action shown in FIG. 6, thereby completing one stroke of the rowing action. Leg muscles, core muscles, back muscles and hand muscles all are used during this stoke of rowing action, so this stoke is usually performed for full body workout, and is performed by more times for aerobic exercise, interval training or professional rowing training.

On the other hand, a bodybuilder operates the rowing exercise machine by different rowing action for training back muscles particularly. For example, the movable user support 910 is slidably connected with the sliding rail structure 900, the user can put feet on the foot plate 920 by the way shown in FIG. 5 or FIG. 6, and does not bend leg during the stroke of rowing action. Only back muscles and hand muscles of the user's upper body are used as active muscles to pull and receive the handle assembly 500 during the rowing action, and the user's core muscles are used to make the rowing action stably, so that the back muscles and hand muscles may be trained in a maximal degree, more particularly the latissimus dorsi muscle of the back muscles. This stroke of rowing action in the second mode is generally used to train and grow back muscles, and is performed by a higher resistance and lower times for training.

The handle assembly 500 of the present disclosure may further include a bar-shaped handle, a V-shaped handle, a U-shaped handle, a single hand handle or rope, to comprehensively train the back muscles. By selecting different type handle, the user can effective focus on training for different group of back muscles.

For example, when selecting the handle assembly 500 with the bar-shaped handle and positively gripping the bar-shaped handle (that is, the palm faces downwardly), the user can pull the handle assembly 500 towards the belly to effectively train the latissimus dorsi muscle; if the user reversely grips the bar-shaped handle (that is, the palm faces upwardly), the user's elbow may be closer to the body during the pulling action, thereby training the latissimus dorsi muscle more. As a result, different ways of gripping the handle can train different muscles.

When selecting the handle assembly 500 with the V-shaped handle or the U-shaped handle, the user can grip the handle assembly 500 with palms facing to each other, and pull back the handle in a nature angle without outwardly rotating arms. Generally, the V-shaped handle can be used to train lower back muscles, and the U-shaped handle can be used to train middle back muscles.

Furthermore, in order to prevent from the imbalance of the left and right muscles due to nonuniform force during training, the user can select the handle assembly 500 with the single hand handle or the rope to complete the stroke of rowing action by single hand, thereby solving the problem of nonuniform force at left and right sides. The handle assembly 500 with the single hand handle or the rope is also suitable for the user who only can use single hand to operate the rowing exercise machine of the present disclosure.

Furthermore, the user can also pull back the handle assembly 500 towards the chest, in order to effective train rear part of the deltoid muscle. Therefore, the rowing exercise machine of the present disclosure can be operated in different training modes to meet various demands.

Furthermore, the rowing exercise machine of the present disclosure may prevent the user from sport injure. For example, during the pulling action, the power output module 200 provides pulling-back resistance against the pulling action, and if the pulling-back resistance provided by the power output module 200 is too large in the recovery action, the user may be quickly towed by the pulling-back resistance, which easily results in the user's sport injure. For this reason, the encoder 204 senses the operational state of the motor 201 and transmits the sensing signal 2041 to the controlling device 203, and the controlling device 203 transmits the control signal 2031 to control the motor 201 to change its revolving speed, so that the power output module 200 provides a restoring force lower than the pulling-back resistance to drive the cable rolling device 300 to receive the cable 800.

For example, the operational state of the motor 201 includes a rotational position, a rotational speed, a rotational angular velocity or a rotational acceleration, and the encoder 204 senses the operational state of the motor 201; when the motor 201 provides a resistance and rotates in a counter-clockwise direction, a counter-clockwise torque is generated to enable the cable rolling device 300 to receive the cable, if the user performs the pulling action and the user's pull force is higher than the resistance, the user is able to pull the cable rolling device 300 to rotate in a clockwise direction, so that the motor 201 is further driven to rotate clockwisely. At this time, the resistance provided by the motor 201 is still applied in the counter-clockwise direction, if the user's pull force is lower than the resistance provided by the motor 201, the resistance forces the motor 201 to rotate in the counter-clockwise direction to drive the cable rolling device 300 to receive the cable 800, so that the motor 201 can be controlled to output the restoring force lower than the reverse resistance while the cable 800 is received, thereby protect the user from sport injure. The encoder 204 is able to sense the change in one or combination of the rotational position, rotational velocity, angular velocity of an output shaft of the motor 201 due to different rotational direction, and output sensing signal 2041 to the controlling device 203. The controlling device 203 controls the motor 201 according to the sensing signal 2041 and the setting data 7001 from the operating module 700, thereby adjusting the resistance outputted from the power output module 200.

Furthermore, the resistance outputted from the power output module may be fixed, or linearly or quadratically varied, or varied based on a preset function. A relationship between the change in resistance outputted from the power output module 200 and the rotational position, velocity or the acceleration of the cable rolling device 300 may be a ratio relationship, a linear relationship, a quadratic relationship or a functional relationship. Therefore, besides the scheme of adjusting the resistance outputted from the power output module 200 in the stroke of rowing action under aforementioned relationship, the rowing exercise machine of the present disclosure may also provide different training mode for the user according to preset data of the operating module 700, for example, the resistance variance between strokes of rowing action or during each stroke of rowing action may be different in aerobic training mode and interval training mode.

The present disclosure disclosed herein has been described by means of specific embodiments. However, numerous modifications, variations and enhancements can be made thereto by those skilled in the art without departing from the spirit and scope of the invention set forth in the claims.

What is claimed is:

1. A rowing exercise machine, comprising:

a support structure;

a power output module disposed at one end of the support structure, and comprising:

a motor;

a controlling device electrically connected to the motor, configured to receive a sensing signal and setting data, and generate a control signal according to the sensing signal and the setting data; and an encoder electrically connected to the controlling device, configured to sense an operational state of the motor and output the sensing signal;

a cable rolling device coupled to the power output module and rotating in a same direction as the motor;

a cable with one end wound on the cable rolling device;

a handle assembly coupled to one opposite end of the cable, and configured to be held by a user to complete a stroke of rowing action; and an operating module electrically connected to the power output module and configured to input the setting data to the controlling device;

wherein the stroke of rowing action comprises a pulling action and a recovery action, and during the pulling action, the power output module provides a reverse resistance against the pulling action, so that the motor counter-rotates correspondingly to the pulling action;

wherein when a force of the pulling action is lower than the reverse resistance, the motor is back to an original rotational direction thereof, and when the encoder senses a change in the rotational direction of the motor, the encoder transmits the sensing signal to the controlling device, and the controlling device transmits the control signal to control the motor, so that the power output module provides a restoring force to drive the cable rolling device to receive the cable, thereby completing the recovery action.

2. The rowing exercise machine according to claim 1, wherein the power output module further comprises a torque enhancing device coupled to the motor and configured to output a revolving speed lower than a revolving speed of the motor and to output torque higher than torque of the motor.

3. The rowing exercise machine according to claim 1, wherein the pulling action and the recovery action are horizontal motions, and directions of the resistance outputted from the power output module are the same during the pulling action and the recovery action.

4. The rowing exercise machine according to claim 1, further comprising a movable user support and a foot plate which are disposed on the support structure.

5. The rowing exercise machine according to claim 1, wherein the power output module outputs resistance of different magnitudes during the pulling action and the recovery action.

6. The rowing exercise machine according to claim 1, further comprising a pulley disposed on the support structure, wherein the cable runs through the pulley.

7. The rowing exercise machine according to claim 1, further comprising a display device configured to display the setting data inputted into the power output module through the operating module.

8. The rowing exercise machine according to claim 1, wherein the operational state comprises a rotational position, a rotational velocity or a rotational acceleration of an output shaft of the motor.

9. The rowing exercise machine according to claim 1, wherein the resistance outputted from the power output module is fixed, or linearly or quadratically varied, or varied based on a preset function.

10. The rowing exercise machine according to claim 1, wherein a relationship between a change in resistance outputted from the power output module and the rotational position, velocity or the acceleration of the cable rolling device is a ratio relationship, a linear relationship, a quadratic relationship or a functional relationship.

* * * * *